US006296534B1

(12) United States Patent
Yi

(10) Patent No.: US 6,296,534 B1
(45) Date of Patent: Oct. 2, 2001

(54) ENCAPSULATED ELECTRICAL ADAPTER ASSEMBLY AND METHOD OF PRODUCING THE SAME

(75) Inventor: Li-Ming Yi, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/742,141

(22) Filed: Dec. 19, 2000

(30) Foreign Application Priority Data

Aug. 16, 2000 (TW) ..... 089116563

(51) Int. Cl.[7] ..... H01R 4/02

(52) U.S. Cl. ..... 439/876; 439/83; 439/76.1; 439/638; 29/843; 174/263

(58) Field of Search ..... 439/876, 83, 76.1, 439/607, 638; 174/35 C, 263; 29/843

(56) References Cited

U.S. PATENT DOCUMENTS 4,700,473 * 10/1987 Freyman et al. ..... 29/846

FOREIGN PATENT DOCUMENTS 5-217616 * 8/1993 (JP) ..... 174/263

* cited by examiner

*Primary Examiner*—Tho D. Ta
(74) *Attorney, Agent, or Firm*—Wei Te Chung

(57) ABSTRACT

An electrical adapter assembly (1) comprises an adapter plate (16), and first and second electrical connectors (12, 14) mounted onto opposite first and second surfaces (165, 166) of the adapter plate. The first and second connectors comprise first and second conductive contact tail portions (1232, 1432), respectively, projecting beyond the second and first surfaces, respectively. A method of encapsulating the electrical adapter assembly comprises the following steps. First, trimming the first and second tail portions for facilitating subsequent formation of smooth soldered dots (21). Second, soldering the first and second tail portions to the adapter plate, forming the smooth soldered dots. Third, placing insulative layers (23, 24) over the soldered dots. Fourth, placing shielding layers (25, 25', 26, 26') over the insulative layers. Fifth, soldering edges of the shielding layers to the adapter plate with soldering tin (27). Sixth, enclosing the adapter assembly within a non-conductive material by injection molding.

17 Claims, 14 Drawing Sheets

ENCAPSULATED ELECTRICAL ADAPTER ASSEMBLY AND METHOD OF PRODUCING THE SAME

BACKGROUND OF THE INVENTION

1. Field of the Invention

The present invention relates to a method of encapsulating an electrical adapter assembly, and particularly to a method which provides effective shielding and grounding functions.

2. Description of Prior Art

Electrical connectors in a computer are connected to each other to transmit electrical signals therebetween. If connectors have the same standard, they can be directly engaged with each other. An electrical adapter is required to electrically connect two connectors which have different standards. The adapter must have good grounding and shielding characteristics, for effective transmission of high speed and high frequency electrical signals.

In earlier times, conventional electrical adapters usually consisted of flat cables or wires. However, the flat cables or wires were not provided with shielding means. With the development of computers, an adapter plate with a shielding cover is now commonly used. The cover is stamped from tinplate.

Referring to FIG. 9, Taiwan Patent Application No. 82206792 discloses such kind of adapter plate and cover. A conventional adapter assembly 6 comprises a first connector 60, a second connector 61, dual stacked adapter plates 62, 63 for electrically connecting the first connector 60 to the second connector 61, and a pair of inner shields 64, and a pair of outer covers 65 covering the inner shields 64. Each inner shield 64 forms a plurality of contact tabs 641 at opposite ends thereof, for electrically contacting conductive shells (not labeled) of the first and second connectors 60, 61, respectively. One shield 64 forms several latches 642 at opposite side walls thereof. The other shield 64 has opposite side walls 642. In assembly, the shield 64 are covered over the adapter plates 62, 63, with the latches 642 latching with the side walls 643. Shielding and grounding is thereby provided. However, the plate-like shields 64 cannot reliably seal off the adapter plates 62, 63. Additionally, the shields 64 are made from tinplates, which are relatively expensive raw materials.

FIG. 10 illustrates Taiwan Patent Application No. 88121901A01, filed on Mar. 31, 2000 by the Applicant of the present invention. The said Application discloses a "Z" shaped adapter assembly 7 which includes a first electrical connector 70, a second electrical connector 71, an adapter plate 72 connecting the first connector 70 to the second connector 71, and a conductive shell 75 covering the first and second connectors 70, 71 and the adapter plate 72. The first and second connectors 70, 71 have first and second tail portions 73, 74 projecting beyond respective opposite surfaces of the plate 72. However, the conductive shell 75 is also plate-like, and is also stamped from a tinplate. Furthermore, pressing force produced during injection molding of the conductive shell 75 can cause the conductive shell 75 to deform inwardly. Upon deformation, the conductive shell 75 can even contact the exposed tail portions 73, 74 of the first and second connectors 70, 71. Such contact results in a short circuit.

Hence, an improved electrical adapter assembly and a method of encapsulating the same are required to overcome the disadvantages of the prior art.

BRIEF SUMMARY OF THE INVENTION

A first object of the present invention is to provide a method of encapsulating an electrical adapter assembly having effective shielding and grounding characteristics;

A second object of the present invention is to provide an electrical adapter assembly providing reliable signal transmission between electrical connectors having different standards.

An electrical adapter assembly in accordance with the present invention comprises an adapter plate, and first and second electrical connectors mounted onto opposite first and second surfaces of the adapter plate. The first and second connectors comprise first and second conductive contacts, respectively. The first and second conductive contacts have tail portions projecting beyond the second and first surfaces of the adapter plate, respectively.

A method of encapsulating the electrical adapter assembly comprises steps described below. First, trimming the first and second tail portions to facilitate subsequent formation of smooth soldered dots. Second, soldering the first and second tail portions to the adapter plate, forming the smooth soldered dots. Third, placing insulative layers over the soldered dots. Fourth, placing shielding layers over the insulative layers; Fifth, soldering edges of the shielding layers to the adapter plate with soldering tin; Sixth and finally, enclosing the adapter assembly within a non-conductive material by injection molding.

Other objects, advantages and novel features of the invention will become more apparent from the following detailed description of the present embodiment when taken in conjunction with the accompanying drawings.

DETAILED DESCRIPTION OF THE INVENTION

Figure 1:
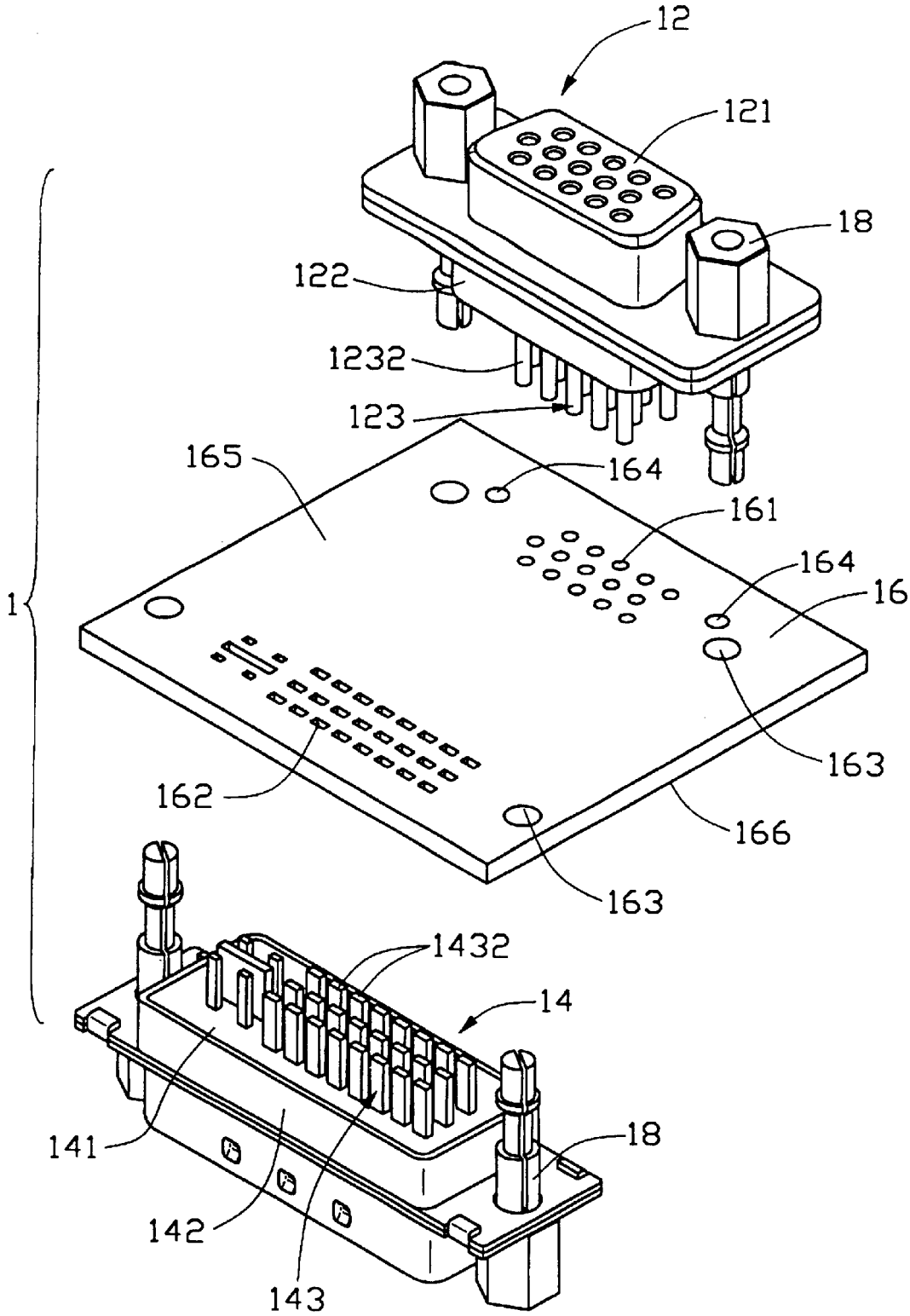
FIG. 1 is an exploded view of an adapter assembly of the present invention prior to encapsulation.

Referring to FIG. 1, an electrical adapter assembly 1 in accordance with the present invention comprises a first electrical connector 12, a second electrical connector 14, and an adapter plate 16 electrically connected between the first connector 12 and the second connector 14.

The first electrical connector 12 comprises a first dielectric housing 121 defining a plurality of passageways (not labeled) for receiving a corresponding number of first conductive contacts 123 therein. Each first conductive contact 123 comprises a first tail portion 1232 protruding beyond a first connecting portion 122 of the first housing 121. A pair of latching posts 18 is arranged at respective opposite ends of the first housing 121, for attaching the first connector 12 to a first surface 165 of the adapter plate 16.

The second connector 14 has a structure similar to that of the first connector 12, and comprises a second dielectric housing 141 receiving a plurality of second conductive contacts 143. Each second conductive contact 143 includes a second tail portion 1432 protruding beyond a second connecting portion 142 of the second housing 14. A pair of latching posts 18 is arranged at respective opposite ends of the second housing 141, for attaching the second connector 14 to a second surface 166 of the adapter plate 16 opposite to the first surface 165.

The adapter plate 16 defines an array of first through holes 161, and an array of second through holes 162. The arrays of first and second through holes 161, 162 are defined near respective opposite edges of the adapter plate 16, for respectively receiving corresponding first and second tail portions 1232, 1432 of the first and second contacts 123, 143 therein. A pair of post holes 163 is defined in the adapter plate 16 at respective opposite sides of each of the arrays of first and second through holes 161, 162, for latching with the corresponding latching posts 18 of the first and second connectors 12, 14 respectively. A pair of third through holes 164 is defined in the adapter plate 16 near respective post holes 163 which are near the first through holes 161.

Before encapsulation of the adapter assembly 1, the first and second connectors 12, 14 are attached to the first and second surfaces 165, 166 of the adapter plate 16, respectively. The procedures for such attachments of the first and second connectors 12, 14 are similar. Thus, only the procedure for attachment of the second connector 14 to the second surface 166 is described in detail herein.

Figure 2:
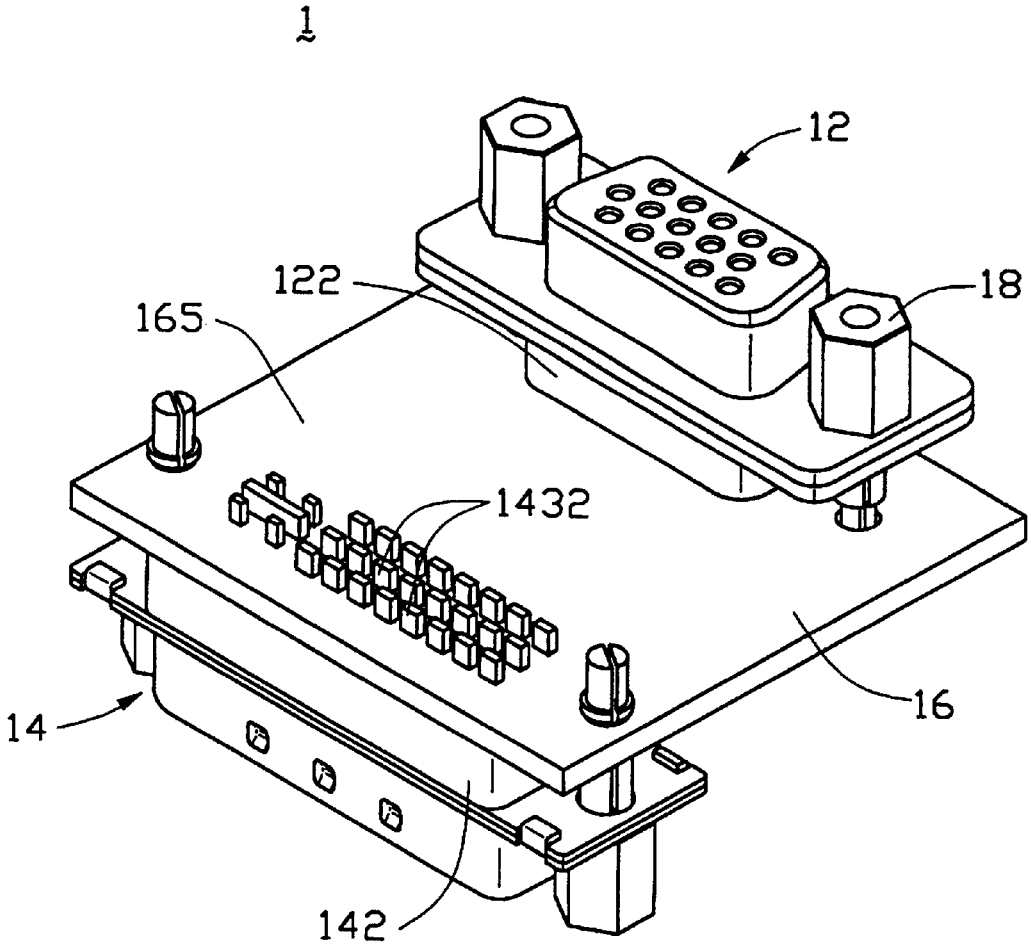
FIG. 2 is an assembled view of FIG. 1.

Referring to FIGS. 1 and 2, the second connector 14 is put into a receiving device (not shown). The adapter plate 16 is placed horizontally on the receiving device, with the second surface 166 of the adapter plate 16 confronting the second connector 14. The second through holes 162 and the post holes 163 of the adapter 16 are oriented to correspond to the tail portions 1432 of the second contacts 143 and the latching posts 18, respectively. The second connector 14 is then pushed toward the second surface 166 of the adapter plate 16 until the connecting portion 142 of the second connector 14 abuts against the second surface 166. The tail portions 1432 of the second connector 14 protrude beyond the first surface 165 of the adapter plate 16, and the latching posts 18 latch in the post holes 163.

The first and second connectors 12, 14 are then encapsulated with the adapter plate 16 according to the steps described in detail below. The first and second connectors 12, 14 undergo stages of encapsulation with the adapter plate 16 at the same time and in similar fashion. Thus, in general, only the steps for encapsulation of the second connector 14 to the adapter plate 16 will be described in detail herein.

Figure 3:
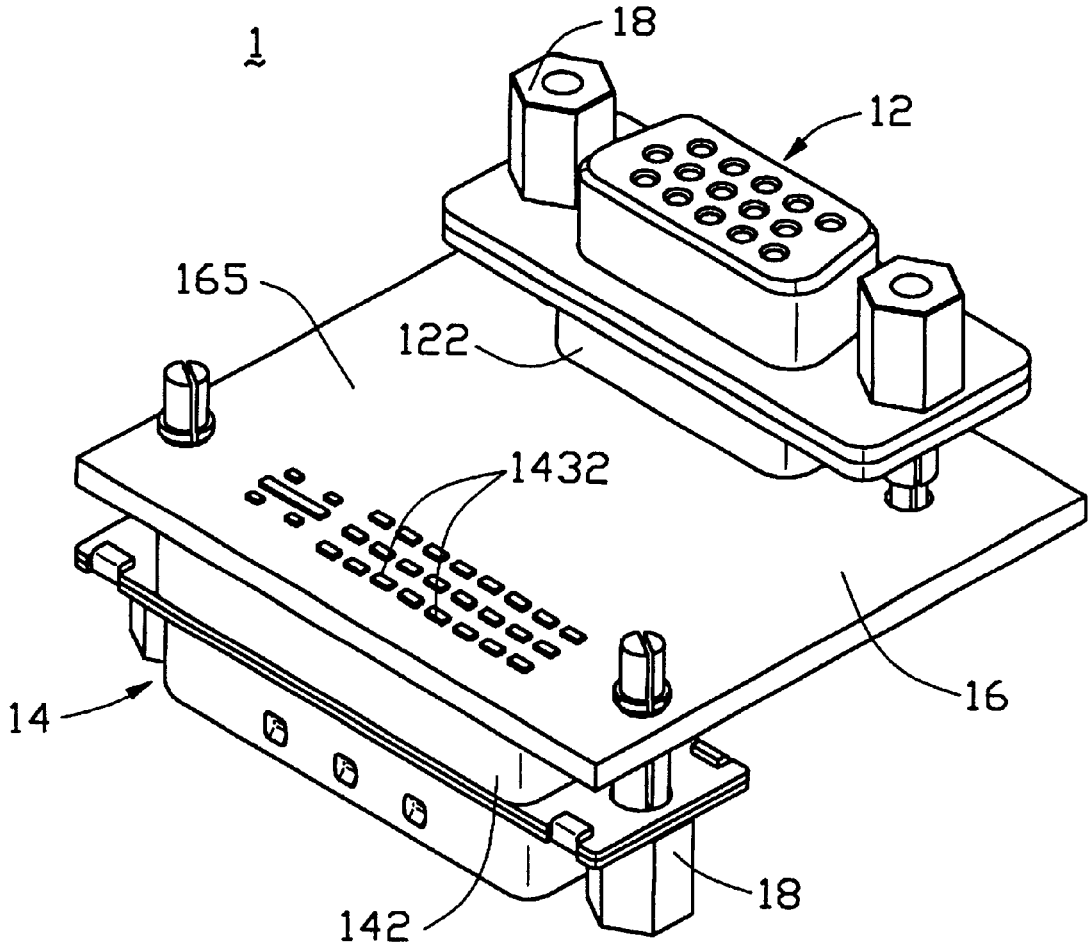
FIG. 3 is a perspective view of the adapter assembly of FIG. 2 after a first step of encapsulation.

First, referring to FIG. 3, the tail portions 1432 of the second connector 14 are trimmed to be substantially coplanar with the first surface 165 of the adapter plate 16. After trimming, the tail portions 1432 protrude beyond the first surface 165 approximately 0.2 to 0.4 mm, to facilitate subsequent formation of smooth soldered dots over the tail portions 1432.

Figure 4:
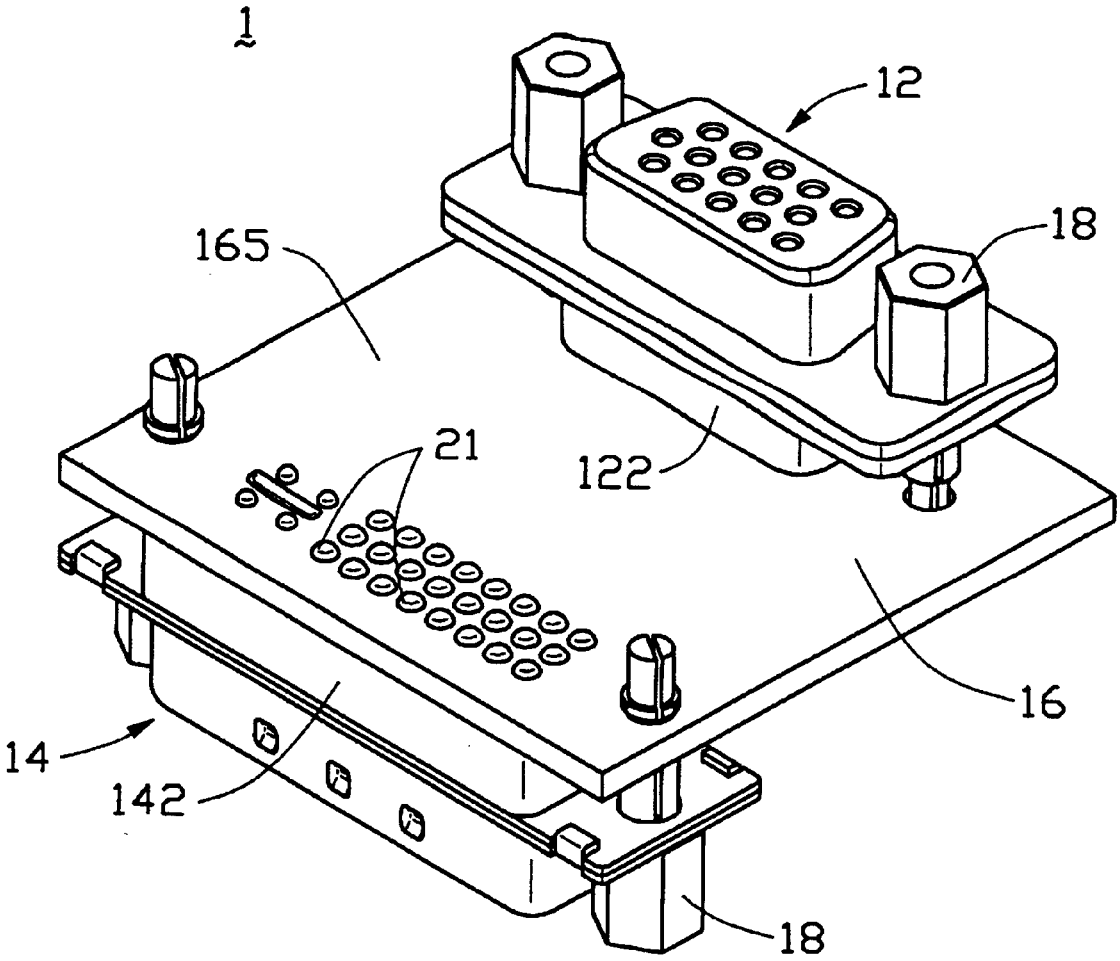
FIG. 4 is a perspective view of the adapter assembly of FIG. 2 after a second step of encapsulation.

Second, referring to FIG. 4, the tail portions 1432 are soldered to the adapter plate 16 at the second through holes 162 using soldering tin (not labeled). After soldering, each tail portion 1432 is entirely covered with a generally hemispherical soldered dot 21.

Figure 5A:
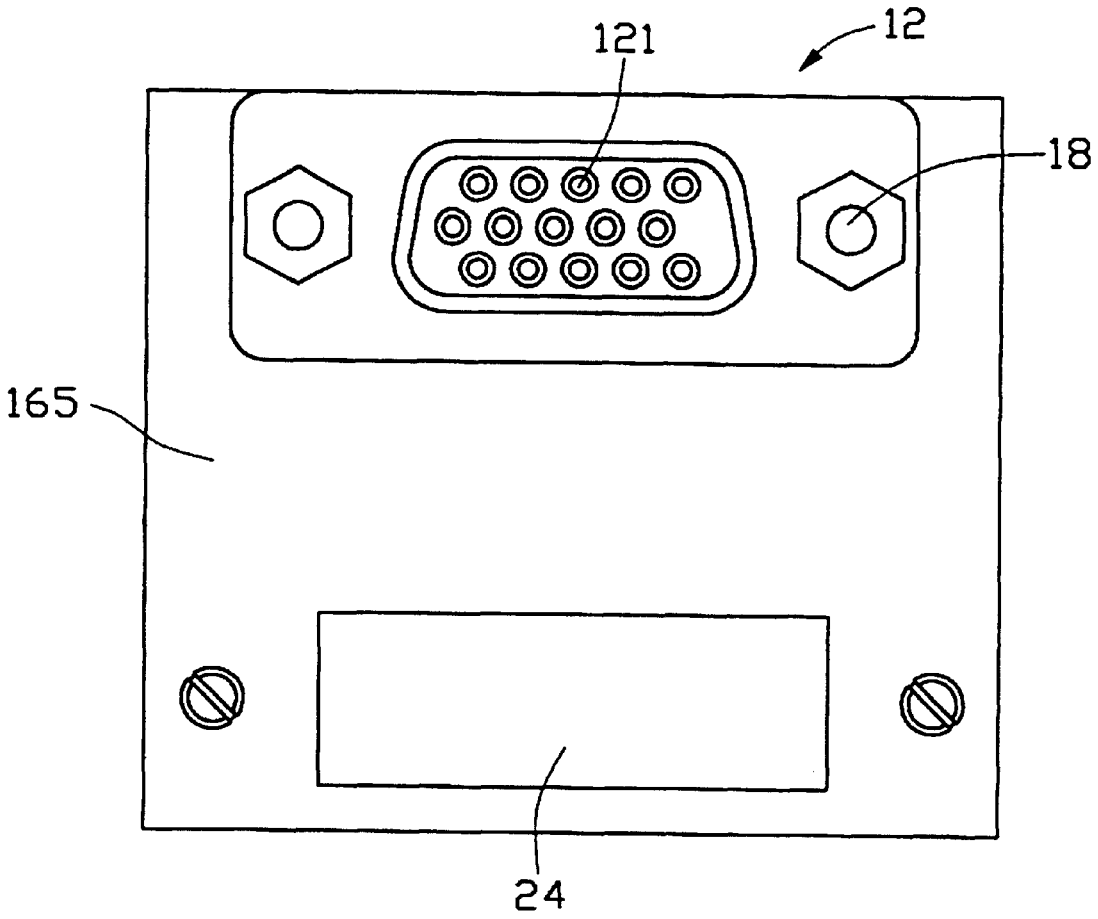
FIG. 5A is a top planar view of the adapter assembly of FIG. 2 after a third step of encapsulation.
Figure 5B:
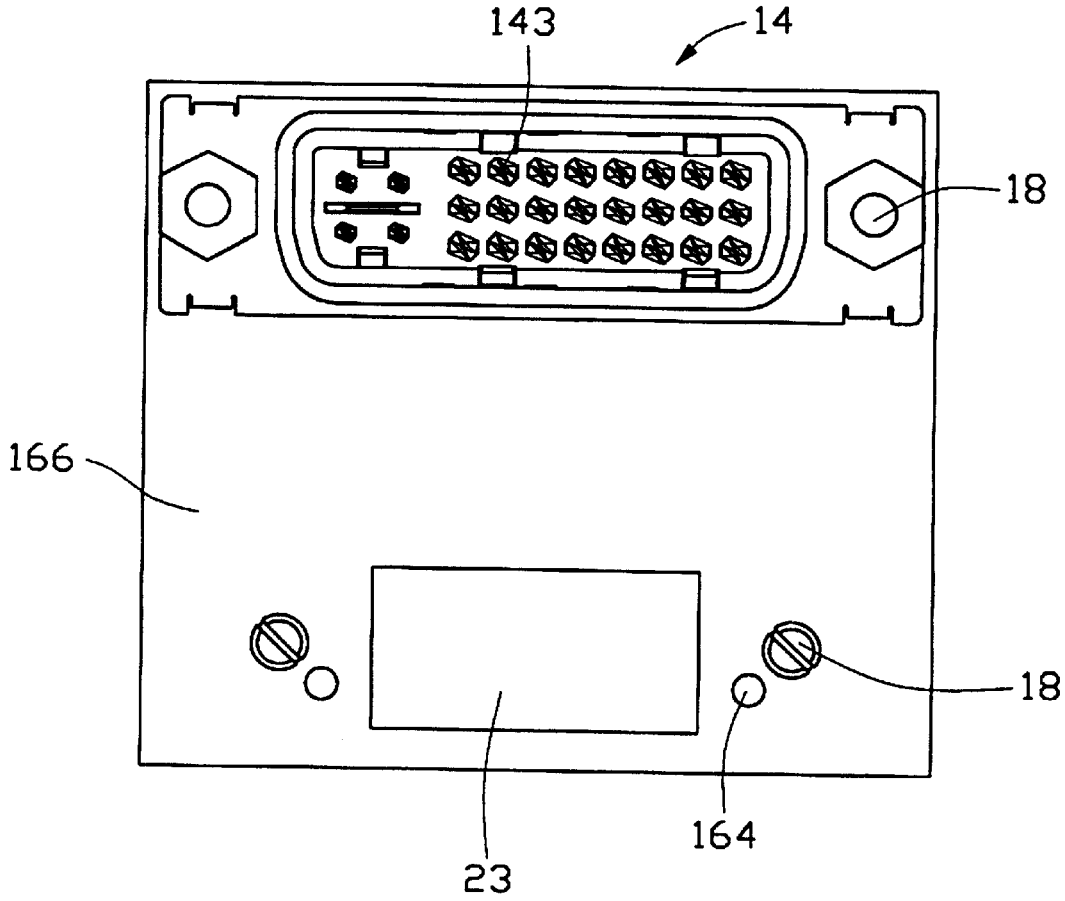
FIG. 5B is a bottom planar view of the adapter assembly of FIG. 2 after a third step of encapsulation.

Third, referring to FIGS. 5A and 5B, rectangular second and first insulative layers 24, 23, each comprise dual layers. The thickness of each second and first insulative layer 24, 23 is slightly greater than the height of the soldered dots 21. The second insulative layer 24 is placed over the soldered dots 21 of the tail portions 1432 of the second connector 14 (see FIG. 5A), and the first insulative layer 23 is placed over the soldered dots 21 of the tail portions 1232 of the first connector 12 (see FIG. 5B). The insulative layer 23 does not cover the third holes 164, for reasons explained hereinafter.

Figure 6A:
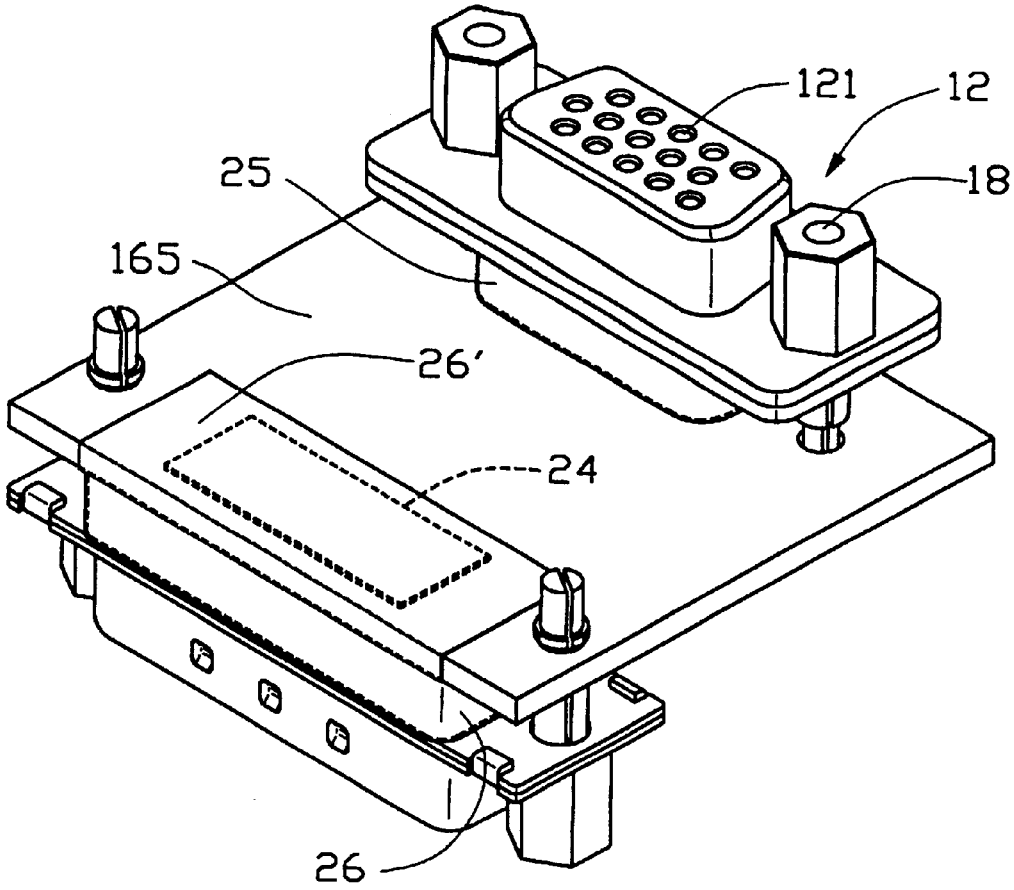
FIG. 6A is a perspective view of the adapter assembly of FIG. 2 after a fourth step of encapsulation.
Figure 6B:
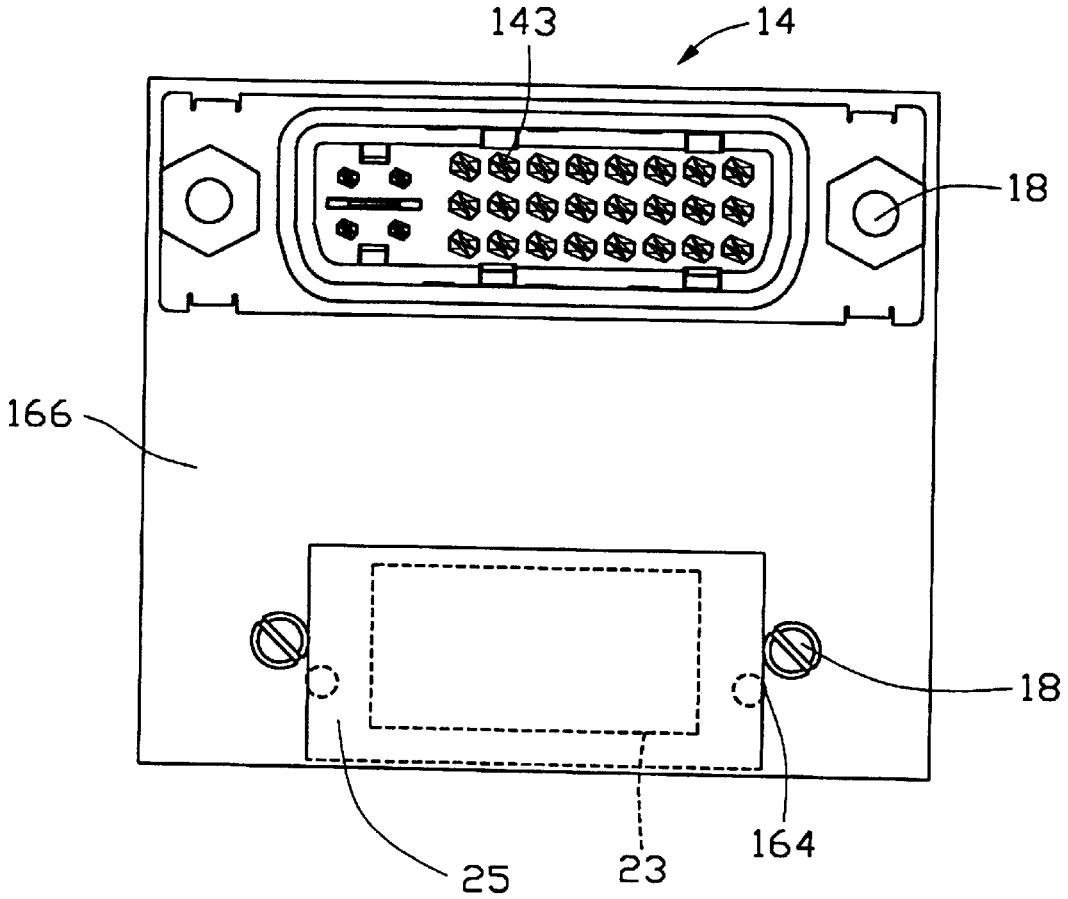
FIG. 6B is bottom planar view of the adapter assembly of FIG. 2 after a fourth step of encapsulation.

Fourth, referring to FIGS. 6A and 6B, second and first peripheral shielding layers 26, 25 are made from copper or similar material. Understandably, the first and second peripheral shielding layers 25, 26 may be the back shells of the connector. Second and first bent shielding layers 26', 25' are also made from copper or similar material. The second peripheral shielding layer 26 is wrapped around the second connecting portion 142 of the second connector 14. The second bent shielding layer 26' is placed over the second insulative layer 24 on the adapter plate 16 and bent downwardly to cover a portion of the second peripheral shielding layer 26, as is best seen in FIG. 7C. Similarly, the first peripheral shielding layer 25 is wrapped around the first connecting portion 122 of the first connector 22, and the first bent shielding layer 25' is placed over the first insulative layer 23 and bent downwardly to cover a portion of the first peripheral shielding layer 25. The first peripheral shielding layer 25 partially or completely covers the third holes 164 of the adapter plate 16 at this time.

Figure 7A:
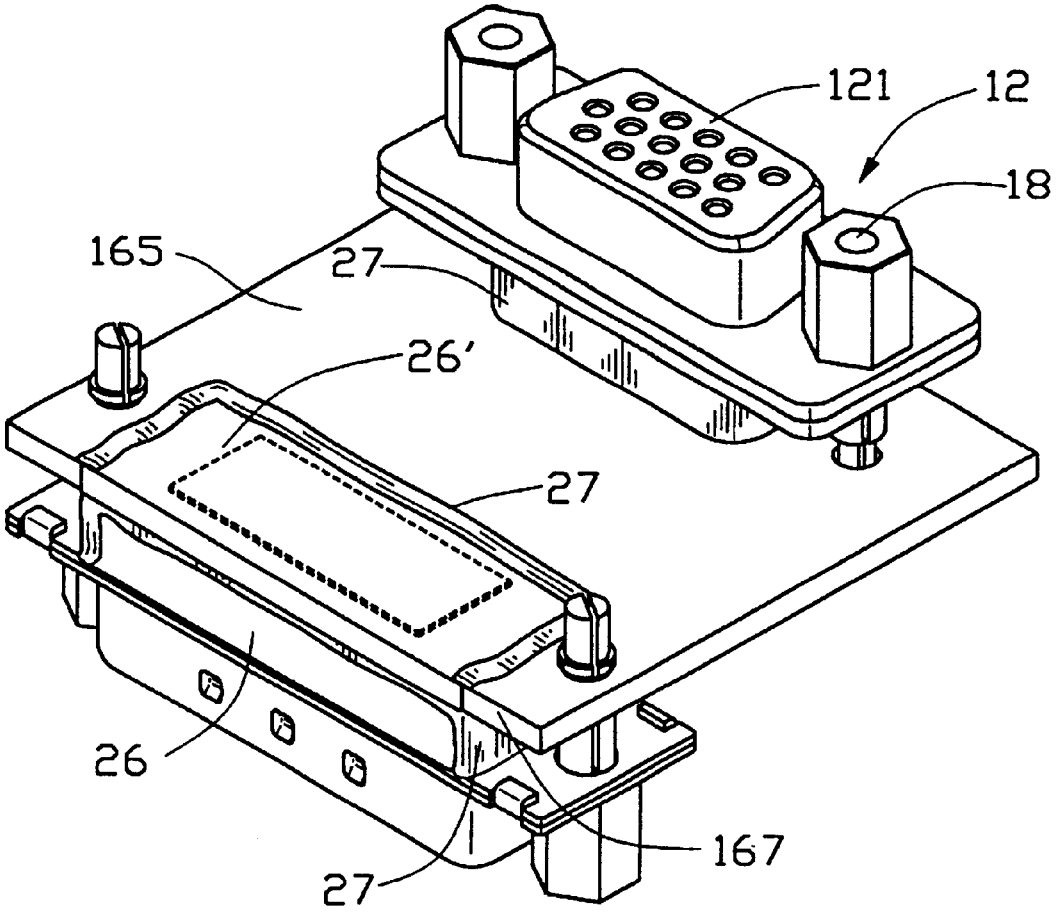
FIG. 7A is a perspective view of the adapter assembly of FIG. 2 after a fifth step of encapsulation.
Figure 7B:
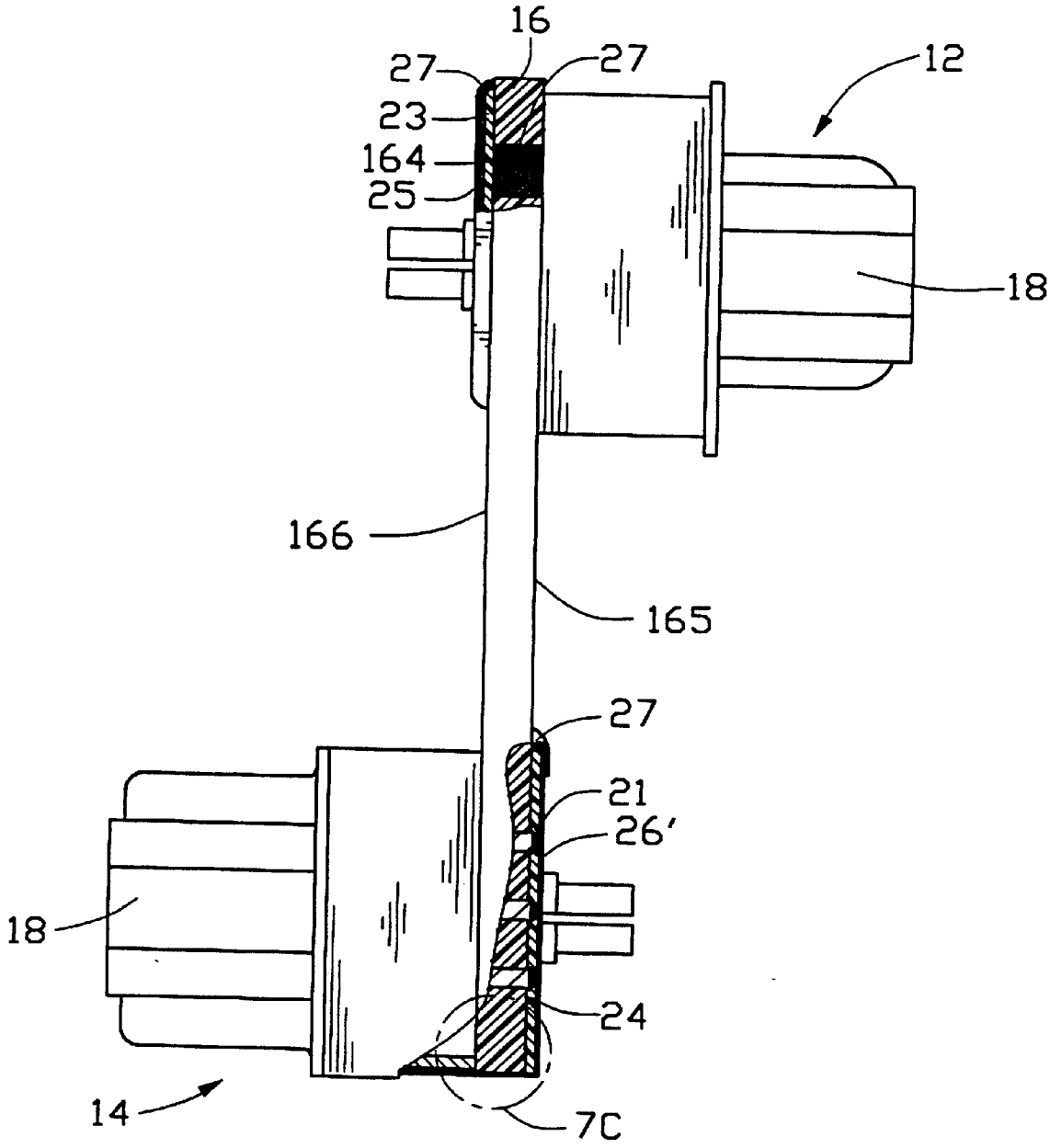
FIG. 7B is a partially cut away side planar view of the adapter assembly of FIG. 2 after a fifth step of encapsulation.
Figure 7C:
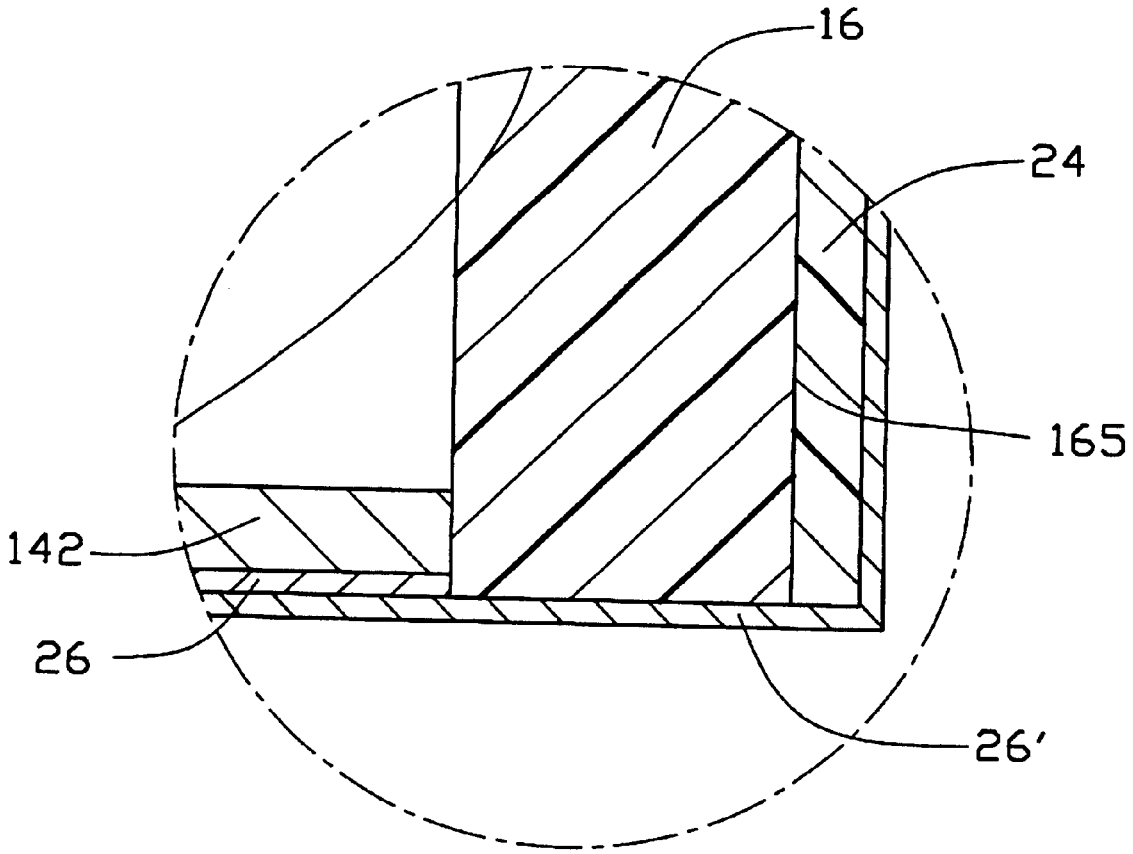
FIG. 7C is an enlarged view of the circular portion 7C of FIG. 7B.

Fifth, referring to FIGS. 7A–7C, the adapter plate 16 has an edge 167. Edges of the second peripheral shielding layer 26, except edges adjacent the edge 167, are soldered to the adapter plate 16 with soldering tin 27. Edges of the second bent shielding layer 26', except for one edge adjacent to the edge 167, are soldered to the adapter plate 16 with the soldering tin 27. The second peripheral shielding layer 26 and the second bent shielding layer 26' are soldered to each other with the soldering tin 27, thereby forming an electrical connection therebetween. The first peripheral shielding layer 25 and the first bent shielding layer 25' of the first connector 12 are soldered to the adapter plate 16 with the soldering tin 27 in the same way. Additionally, the soldering tin 27 is poured into the third holes 164 of the adapter plate 16 at the first surface 165, and such soldering tin 27 is soldered to the first peripheral shielding layer 25 of the first connector 12. Electrical connection between the first peripheral shielding layer 25 and the first bent shielding layer 25' is thereby established.

Figure 8:
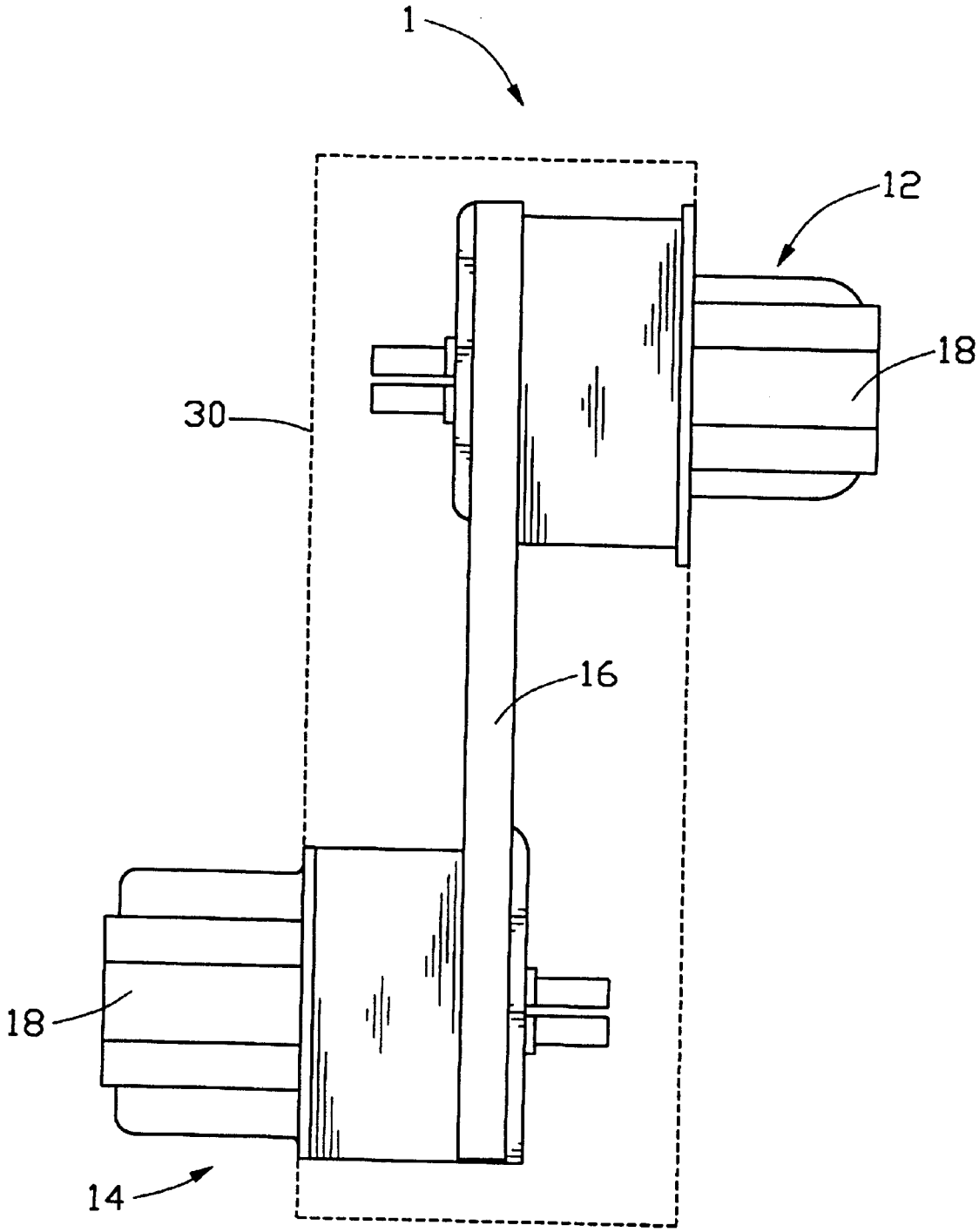
FIG. 8 is a side planar view of the adapter assembly of FIG. 2 after a sixth and final step of encapsulation.
Figure 9:
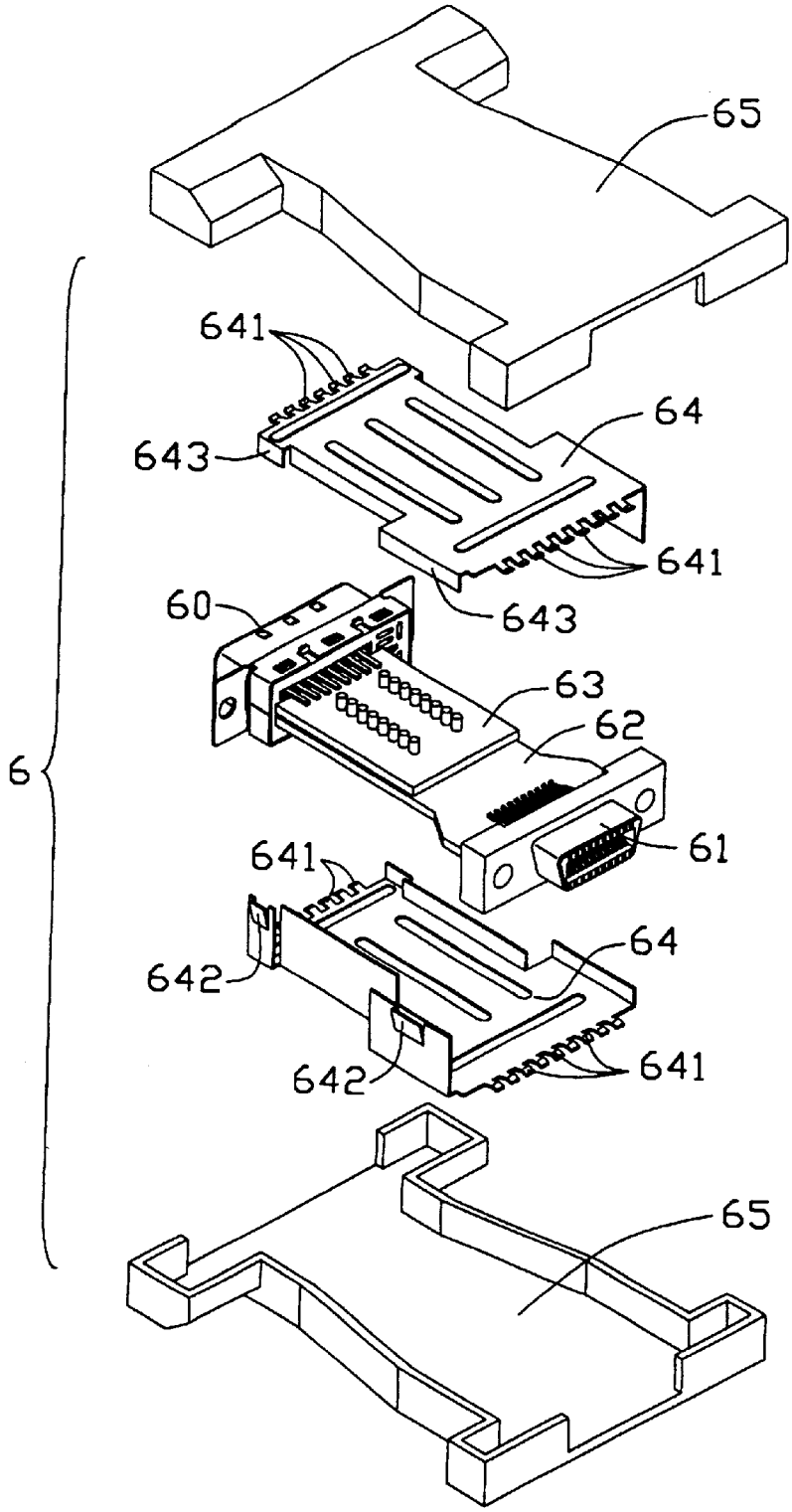
FIG. 9 (PRIOR ART)
FIG. 9 is an exploded view of a conventional adapter assembly.
Figure 10:
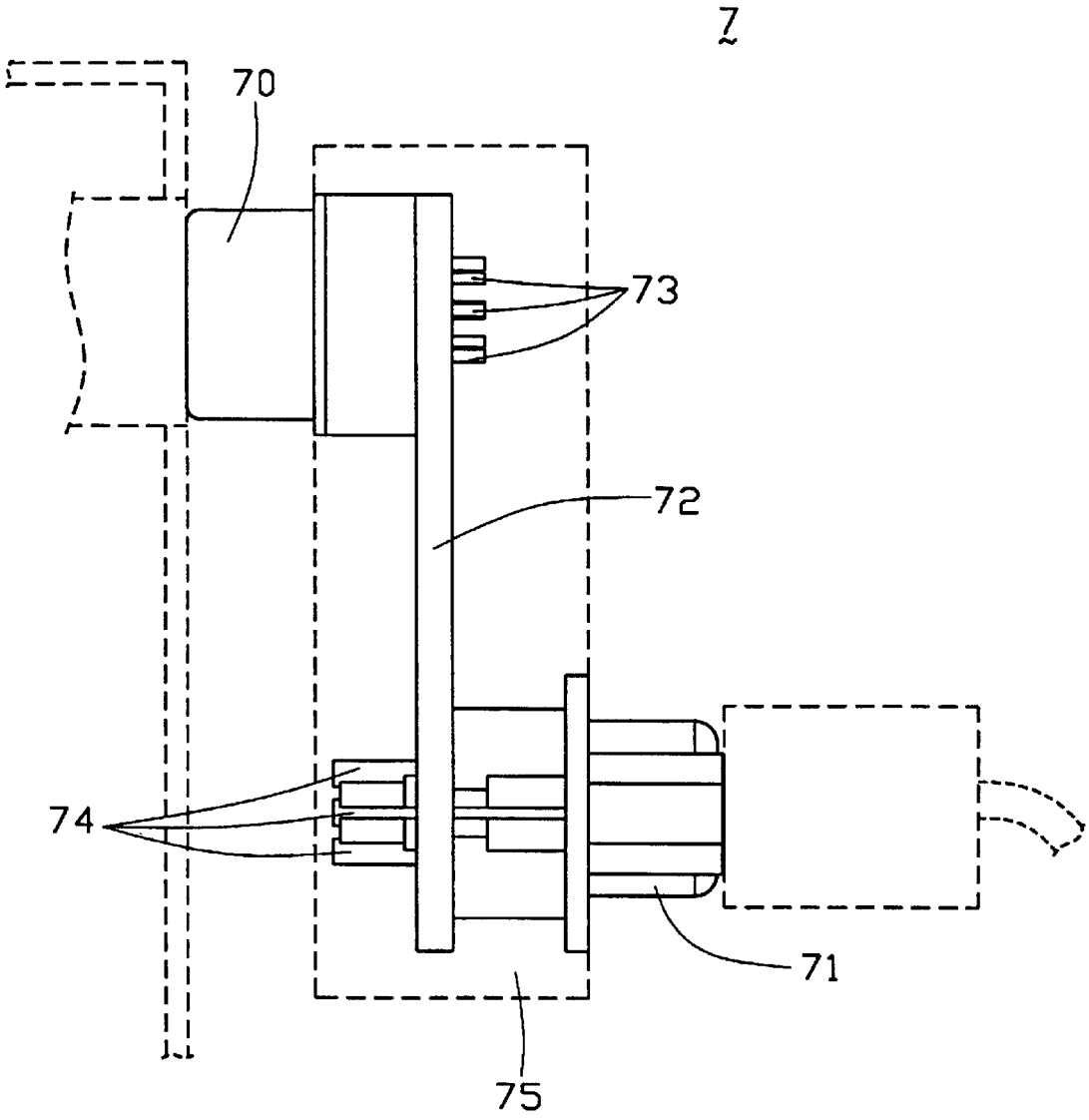
FIG. 10 (PRIOR ART)
FIG. 10 is a schematic side planar view of another conventional adapter assembly.

Sixth and finally, referring to FIG. 8, the connecting portions 122, 142 and the adapter plate 16 are jointly enclosed within a non-conductive material by way of injection molding. The dimensions of the non-conductive material are indicated by a dotted line 30 in FIG. 8. Thus encapsulation of the adapter assembly 1 of the present invention is completed.

The first and second contacts 123, 143 are securely shielded and grounded by the above encapsulating method. The first and second contacts 123, 143 are completely sealed within the shielding means. The encapsulating method is straightforward and cost-saving, and the conductive shell means is not subjected to deformation forces during the encapsulation process.

It is to be understood, however, that even though numerous characteristics and advantages of the present invention have been set forth in the foregoing description, together with details of the structure and function of the invention, the disclosure is illustrativeonly, and changes may be made in detail, especially in matters of shape, size, and arrangement of parts within the principles of the invention to the full extent indicated by the broad general meaning of the terms in which the appended claims are expressed.

What is claimed is:

1. A method of encapsulating an electrical adapter assembly, said adapter assembly comprising a first electrical connector, a second electrical connector and an adapter plate for electrically connecting the first connector to the second connector, said first and second connectors being mounted onto opposite first and second surfaces of the adapter plate, respectively, and having first and second conductive contacts projecting beyond said second and first surfaces of the adapter plate, respectively, the method of encapsulating the adapter assembly comprising:

trimming the first and second tail portions to facilitate subsequent formation of smooth soldered dots;

soldering the first and second tail portions to the adapter plate and forming the smooth soldered dots;

placing insulative layers over the soldered dots;

placing electrically conductive shielding layers over the insulative layers;

soldering edges of the shielding layers to the adapter plate with soldering tin;

enclosing the adapter assembly within a non-conductive material by injection molding; and wherein the first and second connectors comprise first and second connecting portions abutting against the first and second surfaces of the adapter plate, respectively, and the first and second connecting portions are peripherally covered by respective electrically conductive shielding layers.

2. The method of encapsulating the adapter assembly as claimed in claim 1, wherein each soldered dot is generally hemi-spherical.

3. The method of encapsulating the adapter assembly as claimed in claim 1, wherein the shielding layer covering the second tail portions extends from the first surface of the adapter plate to contact the shielding layer covering the second connecting portion of the second connector, and wherein such shielding layers are soldered together with soldering tin.

4. The method of encapsulating the adapter assembly as claimed in claim 1, wherein the first and second tail portions are trimmed to be substantially coplanar with the second and first surfaces of the adapter plate, respectively.

5. The method of encapsulating the adapter assembly as claimed in claim 4, wherein the first and second tail portions are trimmed such that they protrude beyond the second and first surfaces of the adapter plate approximately 0.2 to 0.4 mm, respectively.

6. The method of encapsulating the adapter assembly as claimed in claim 1, wherein each insulative layer is generally rectangular.

7. The method of encapsulating the adapter assembly as claimed in claim 6, wherein the shielding layer associated with the first tail portions cover the through holes of the adapter plate.

8. The method of encapsulating the adapter assembly as claimed in claim 1, wherein the insulative layer associated with the first tail portions does not cover a pair of through holes defined in the adapter plate at opposite sides of the first tail portions.

9. The method of encapsulating the adapter assembly as claimed in claim 8, wherein edges of the respective shielding layers of the first and second connecting portions are soldered to the adapter plate with soldering tin.

10. The method of encapsulating the adapter assembly as claimed in claim 1, wherein the shielding layers are made from copper or similar material.

11. The method of encapsulating the adapter assembly as claimed in claim 10, wherein at least one through hole is defined in the adapter plate at respective opposite sides of the first tail portions, soldering tin is poured into the at least one through hole at the first surface of the adapter plate, and such soldering tin is soldered to the shielding layer covering the first connecting portion of the first connector, thereby establishing electrical connection between the shielding layer associated with the first contact portions and the shielding layer covering the first connecting portion of the first connector.

12. An electrical adapter assembly comprising:

an adapter plate having opposite first and second surfaces and defining a plurality of first through holes;

a first electrical connector being mounted onto the first surface of the adapter plate and comprising a first dielectric housing receiving a plurality of first conductive contacts, each first conductive contact having a first tail portion inserted into a corresponding first through hole of the adapter plate, the first tail portion projecting beyond the second surface of the adapter plate at a distance such that a smooth soldered dot is formed over the first tail portion when the first tail portion is soldered to the adapter plate at the second surface; and a first shielding device being adapted for covering the first tail portions of the first conductive contacts, said shielding device comprising an insulative layer covering the soldered dots and a first bent electrically conductive shielding layer covering the insulative layer, edges of the first bent shielding layer being soldered to the adapter plate with soldering tin for effectively shielding the first tail portions of the first conductive contacts;

wherein the first housing of the first connector comprises a first connecting portion abutting against the first surface of the adapter, the first connecting portion being covered by a first peripheral electrically conductive shielding layer; and wherein the first bent shielding layer extends from the second surface of the adapter plate to contact the first peripheral shielding layer, and the first bent shielding layer and the first peripheral shielding layer are soldered together with soldering tin.

13. The electrical adapter assembly as claimed in claim 12, wherein a second electrical connector is mounted onto the second surface of the adapter plate, the second electrical connector having a structure similar to the structure of the first electrical connector.

14. The electrical adapter assembly as claimed in claim 13, wherein a second shielding device is adapted for shielding the second electrical connector, the second shielding device having a structure similar to the structure of the first shielding device.

15. The electrical adapter assembly as claimed in claim 12, wherein the first bent shielding layer and the first peripheral shielding layer are made from copper or similar material.

16. The electrical adapter assembly as claimed in claim 15, wherein at least one third through hole is defined in the adapter plate near the first through holes, the at least one third through hole is covered by the first bent shielding layer, soldering tin is poured into the at least one third through hole at the first surface of the adapter plate, and such soldering tin is soldered to the first peripheral shielding layer, thereby establishing electrical connection between the first bent shielding layer and the first peripheral shielding layer.

17. An electrical adapter assembly comprising:

an adapter plate having opposite first and second surfaces and defining a plurality of through holes;

a connector mounted onto the first surface, said connector including an insulative housing with a plurality of contacts therein, each of said contacts including a tail portion extending from the first surface through the corresponding through hole and a little bit beyond the second surface, a smooth soldered dot being formed over the corresponding tail portion;

a shielding device including an insulative layer covering the solder dots, and an electrically conductive shielding layer pasted upon said insulative layer; and means for electrically connecting said shielding layer and a rear shell which surrounds a connecting portion of the housing.

* * * * *